US005931224A

United States Patent [19]

Chevallier

[11] Patent Number: 5,931,224

[45] Date of Patent: Aug. 3, 1999

[54] HEAT EXCHANGER OF THE STACKED PLATE TYPE, IN PARTICULAR AN EVAPORATOR FOR AN AIR CONDITIONING CIRCUIT

[75] Inventor: Christophe Chevallier, Le Mans, France

[73] Assignee: Valeo Climatisation, La Verriere, France

[21] Appl. No.: 08/841,189

[22] Filed: Apr. 29, 1997

[30] Foreign Application Priority Data

Apr. 30, 1996 [FR] France ..... 96 05450

[51] Int. Cl.[6] ..... F28D 1/03

[52] U.S. Cl. ..... 165/153; 165/DIG. 466

[58] Field of Search ..... 165/152, 153

[56] References Cited

U.S. PATENT DOCUMENTS

| | | | |
|---|---|---|---|
| 4,723,601 | 2/1988 | Ohara et al. . | |
| 4,800,954 | 1/1989 | Noguchi et al. . | |
| 4,926,932 | 5/1990 | Ohara et al. . | |
| 5,058,662 | 10/1991 | Nguyen et al. | 165/76 |
| 5,111,877 | 5/1992 | Buchanan et al. . | |
| 5,332,032 | 7/1994 | Beddome et al. | 165/153 |
| 5,544,702 | 8/1996 | Nishishita | 165/153 |

OTHER PUBLICATIONS

Patent Abstracts of Japan, vol. 16, No. 122(M–1226), 27 Mars 1992 & JP–A–03 286997 (Showa Alum Corp), Dec. 17, 1991.

*Primary Examiner*—Allen Flanigan
*Attorney, Agent, or Firm*—Morgan & Finnegan, LLP

[57] ABSTRACT

A heat exchanger for use as an evaporator in a motor vehicle air conditioning system comprises a multiplicity of plates stacked in pairs and defining within each pair a flow chamber for a first fluid. Between each pair of plates and the next is a flow passage for a second fluid. Each plate has a bent-back edge portion or plate foot which extends at right angles to the main part of the plate. Each plate foot abuts against a similar plate foot of an adjacent plate, while leaving an area free to define at least one drain passage through the bottom of the heat exchanger which is formed by the overlapping plate feet. Water condensing from the air passed through the evaporator is drained through these drain passages.

10 Claims, 1 Drawing Sheet

HEAT EXCHANGER OF THE STACKED PLATE TYPE, IN PARTICULAR AN EVAPORATOR FOR AN AIR CONDITIONING CIRCUIT

FIELD OF THE INVENTION

This invention relates to heat exchangers of the stacked plate type, for effecting heat transfer between a first fluid and a second fluid. In particular, the invention relates to heat exchangers of the type comprising a multiplicity of heat exchanger plates stacked in pairs, with the plates of any one pair having concavities which face towards each other, the plates of each pair being joined sealingly together at their periphery so as to define a chamber between them through which a first fluid flows; these chambers are in communication with each other through apertures formed in the plates, while the pairs of plates define between them passages for flow of the second fluid; corrugated inserts are fitted in these flow passages for the second fluid.

BACKGROUND OF THE INVENTION

In a heat exchanger of the above type, the first fluid flows from one chamber to another through apertures in the heat exchanger plates, so as to exchange heat with the second fluid flowing in the passages defined between the pairs of plates. Such a heat exchanger is currently used as an evaporator in a coolant fluid circuit for air conditioning the cabin of a motor vehicle, in which the refrigerant fluid is the above mentioned first fluid, the second fluid being atmospheric air.

In general terms, each plate of the heat exchanger is in the form of a shallow tray, and is formed with two holes which act as the inlet and outlet, respectively, for the first fluid. The chamber which is defined between the two plates of any one pair of plates includes an internal partition which gives the fluid flowing in the chamber a U-shaped flow path between the inlet aperture and the outlet aperture. This partition is generally formed by sealingly joining together two longitudinal projecting ribs each of which forms part of a respective one of the plates in the pair of plates concerned. The communicating apertures are usually formed in a projecting element or pocket which is arranged at one end of each plate. In addition, the plates are generally joined together at their other end by a base plate which provides spacing between the pairs of plates.

Where the heat exchanger is an evaporator, the refrigerant fluid enters the heat exchanger in the liquid state and leaves it in the vapour state, after having cooled a stream of air by evaporation. Since this stream of air contains a certain amount of humidity, condensation occurs in contact with the heat exchanger plates, giving rise to trickling of water. It is desirable to eliminate this water. In known heat exchangers of the stacked plate type, this water has a tendency to stagnate on the base plate of the evaporator, and this can give rise to corrosion.

DISCUSSION OF THE INVENTION

The main object of the invention is to overcome the above mentioned drawbacks.

According to the invention, a heat exchanger for transfer of heat between a first fluid and a second fluid, comprising a multiplicity of heat exchange plates in the form of pressings stacked in pairs, in such a way that the plates of any one pair define concavities facing towards each other, the plates of each pair being sealingly joined together at their periphery so as to define within the pair of plates a chamber for flow of the said first fluid, the said chambers being in communication with each other through apertures formed in the plates, and in which the pairs of plates define between them flow passages for the second fluid, with corrugated inserts being mounted in the said flow passages for the second fluid, is characterised in that each plate has a bent-back edge portion, or plate foot, which extends at right angles to the remainder of the plate on the side of the latter opposed to the concavity of the plate, each said bent-back edge portion being adapted to abut against a similar bent-back edge portion of an adjacent plate, while defining, with the latter, at least one drain passage.

Thus, the bent-back edge portions of two adjacent plates cooperate with each other to maintain a spacing between the two plates concerned, while at the same time providing at least one drain passage. As a result, the bent-back edge portions not only act as spacers, which avoids the use of a base plate altogether, but they also provide drain passages, or drain holes, which avoid the occurrence of oxidation or corrosion of the base of the heat exchanger.

Thus, where the heat exchanger is used as an evaporator, the condensates forming on the heat exchanger plates can be easily removed through the above mentioned drain passages.

Preferably, each heat exchanger plate has a generally elongate configuration, and is formed with two flow apertures formed in a boss portion or pocket close to one end of the plate. According to a preferred feature of the invention, the bent-back edge portion constituting the foot of each plate is disposed at the other end of the plate. Where the form of the plate is generally rectangular, the bent-back edge portion extends along one of the minor sides of the rectangle.

According to another preferred feature of the invention, the bent-back edge portion of each plate is formed with indentations which are adapted to inter-penetrate with indentations formed in the homologous bent-back edge portion of the adjacent plate.

In one type of embodiment of the invention, these indentations are in the form of projecting portions alternating with recesses, in equal numbers, so that the projecting portions of one bent-back edge portion are engaged in the recesses of the adjacent bent-back edge portion and vice versa, while leaving a space free to define the drain passages. In this way, it is possible to make a heat exchanger from plates which are all identical with each other.

The projecting portions and recesses are preferably generally rectangular in form, with the projecting portions being narrower than the recesses. Due to this difference in width, a drain passage is formed in each case between a projecting portion and a recess.

According to a further preferred feature of the invention, each of the said recesses has a longitudinal side which is joined at right angles to at least one transverse side of one of the said projecting portions, with a relieving notch being formed at the junction of this longitudinal side with a transverse side. The relieving notches may for example be semi-circular.

The longitudinal side of each recess in the bent-back edge portion of each plate preferably includes a flange. This improves the abutting engagement between a recess of the plate and a corresponding projecting portion of the adjacent plate.

The heat exchanger of the invention is preferably in the form of an evaporator, in which the first fluid is a refrigerant fluid and the second fluid is atmospheric air, with the or each drain passage serving for evacuation of condensates formed in the air flowing through the evaporator.

Further features and advantages of the invention will appear more clearly on a reading of the following detailed description of a heat exchanger in a preferred embodiment of the invention, which is given by way of non-limiting example only and with reference to the accompanying drawings.

DESCRIPTION OF A PREFERRED EMBODIMENT OF THE INVENTION

Figure 1:
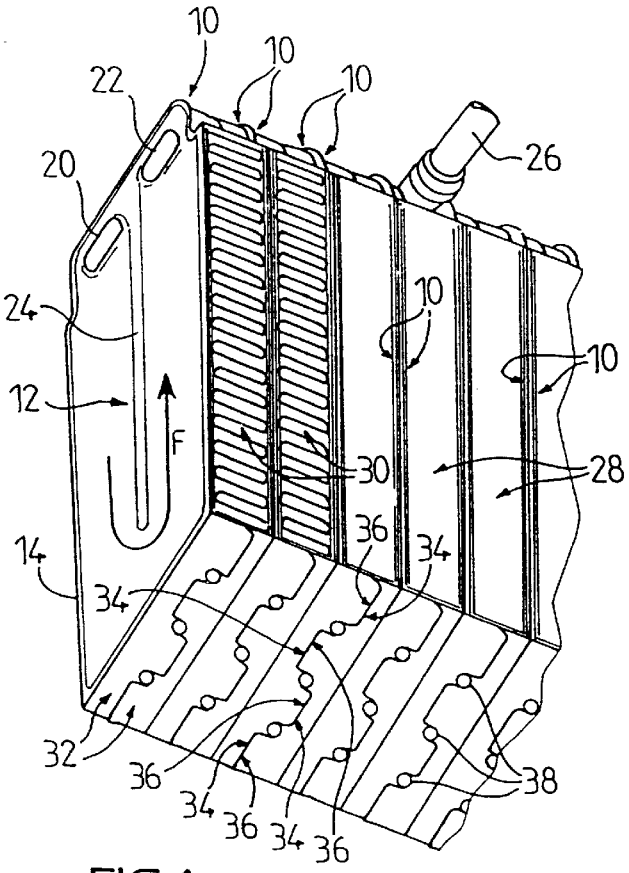
FIG. 1 is a perspective view showing part of a heat exchanger in the form of an evaporator, in accordance with the invention.
Figure 2:
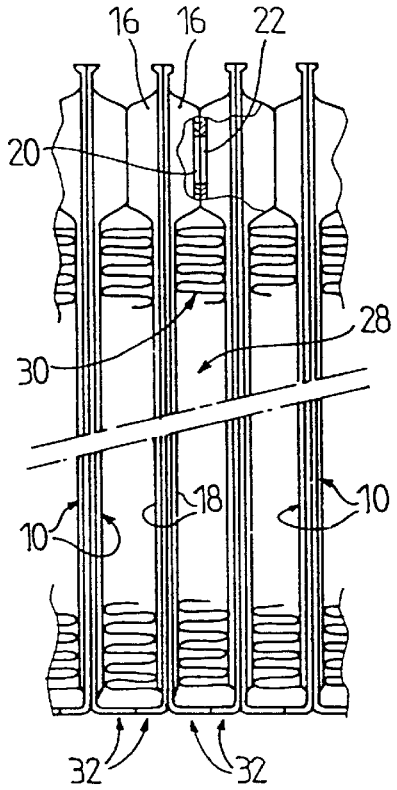
FIG. 2 is a side view, partly in cross section, showing part of the heat exchanger seen in FIG. 1.

Reference is first made to FIGS. 1 and 2, which show a heat exchanger comprising a multiplicity of heat exchanger plates 10 which are stacked in pairs. Each of the plates is a metal pressing in the form of a tray 12 (see the left hand side of FIG. 1). In each pair, the two plates are assembled together in such a way that their concavities defined by the trays 12 face towards each other, so as to define an internal chamber within the pair of plates. Each plate 10 has a peripheral edge 14, FIG. 1, which lies in a vertical plane. The peripheral edge portions 14 of two adjacent trays 12 are assembled together sealingly against ingress or egress of fluid, for example by brazing, so that each of the above mentioned internal chambers of the pairs of plates is sealed.

Each plate 10 is of generally rectangular form. At its upper end it includes a bulged region 16 having an increased depth, which will be referred to as a pocket, together with a shallower region 18 which occupies the major part of the height of the tray. In the pocket region 16, two apertures 20 and 22 are formed, which serve respectively for the inlet and outlet of a first fluid which in this example is a refrigerant fluid. Each of the plates 10 also includes a central partition 24 (see FIG. 1), which is arranged to be assembled together with the homologous central partition 24 of an adjacent plate 10. Thus, each of the chambers defined between two adjacent heat exchanger plates defines a U-shaped flow path, as indicated by the arrow F in FIG. 1, for the refrigerant fluid, which enters the chamber through the aperture 20 and leaves the latter via the aperture 22. The heat exchanger also has at least one inlet tube connection and/or outlet tube connection 26 for the refrigerant fluid, as indicated in FIG. 1.

Thus, the first fluid, or refrigerant fluid, is able to flow in the various chambers which are defined respectively by the pairs of plates. In the sectioned part of FIG. 2, one of the apertures 20 in a plate lying in facing relationship with an aperture 22 of an adjacent plate, so as to bring two adjacent chambers into communication with each other, can be seen.

The shallow regions 18 of two adjacent plates, being part of two different pairs of plates, define between them a gap 28 which constitutes a flow passage for a second fluid. In this example, the second fluid is atmospheric air. Each of these air flow passages 28 contains an insert 30 which is in the form of a corrugated metal plate. The summits of the corrugations of the insert 30 make alternate contact with the shallow regions 18 of the two plates which bound the air flow passage 28.

In this example, the refrigerant fluid enters the heat exchanger in the liquid state, and leaves it in the vapour state, after having, while passing through the heat exchanger, cooled a stream of atmospheric air flowing in the air flow passages 28, with the air giving up heat to the refrigerant fluid. As a result, this air stream is cooled by evaporation of the refrigerant fluid. A heat exchanger of the evaporator type, as described so far, is well known per se, and may be used, in particular, in an air conditioning installation for a motor vehicle.

At its opposite end from the pockets 16, each plate 10 has a bent-back edge portion 32, which will also be referred to as a plate foot. Each plate foot 32 lies at right angles to the general plane of the plate 10 itself, on the side of the latter opposite to its concavity 12, that is to say on the opposite side to the concavity defined by the tray 12. The bent-back edge portion 32 extends along the shorter side of the generally rectangular plate 10.

As is best seen in FIG. 1, each plate foot 32 is formed with indentations which are adapted to inter-penetrate with corresponding indentations of the homologous plate foot of the adjacent plate 10. These indentations are defined by two projecting portions 34 which alternate with two recesses 36. The projecting portions 34 and recesses 36 are of generally rectangular form, so that the projecting portions 34 of one plate foot 32 are engaged in the recesses 36 of the adjacent plate foot, and vice versa. However, the projecting portions 34, which constitute teeth, overlap only part of the corresponding recesses 36, so that at the same time they define three flow passages or drain holes 38.

Thus, when the evaporator is in operation, the condensates which are formed in contact with the plates 10, due to the humidity contained in the stream of atmospheric air, can drain away through the bottom of the evaporator through the flow passages 38. It should be noted that the two adjacent plate feet 32 also serve as abutments and as spacers which maintain a predetermined constant space between the plates at their bottom ends.

Figure 3:
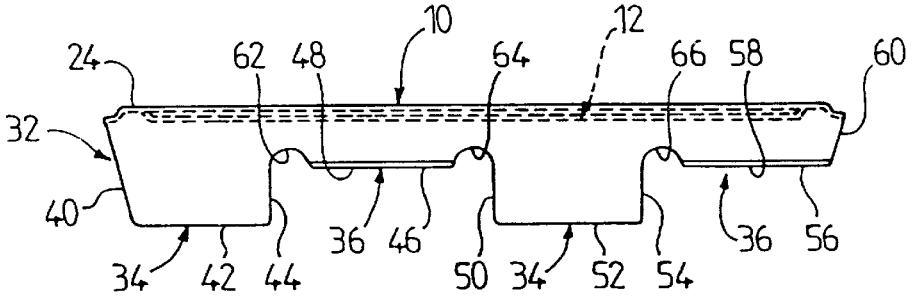
FIG. 3 is a top plan view of a bent-back edge portion of a plate.

One particular embodiment will now be described with reference to FIG. 3. The first projecting portion 34, seen on the left hand side of FIG. 3, is bounded by an oblique transverse side 40, a longitudinal side 42, and a straight transverse side 44. The adjacent recess 36 is bounded by a longitudinal side 46 having a flange 48. In addition, this recess 36 is bounded by a transverse side 50 of the other projecting portion 34. The latter is also bounded by a longitudinal side, 52, and by a transverse side 54. The other recess 36, i.e. that seen on the right hand side of FIG. 3, is bounded by a longitudinal side 56 having a flange 58, and by an oblique transverse side 60.

The longitudinal side 46 of the first recess 36 is joined to the transverse sides 44 and 50 of the adjacent projecting portions 34 through two relieving notches 62 and 64 respectively. These notches are semicircular. Similarly, the longitudinal side 56 of the other recess 36 is joined to the transverse side 54 of the adjacent projecting portion 34 through a further relieving notch 66, which is again semicircular.

Figure 4:
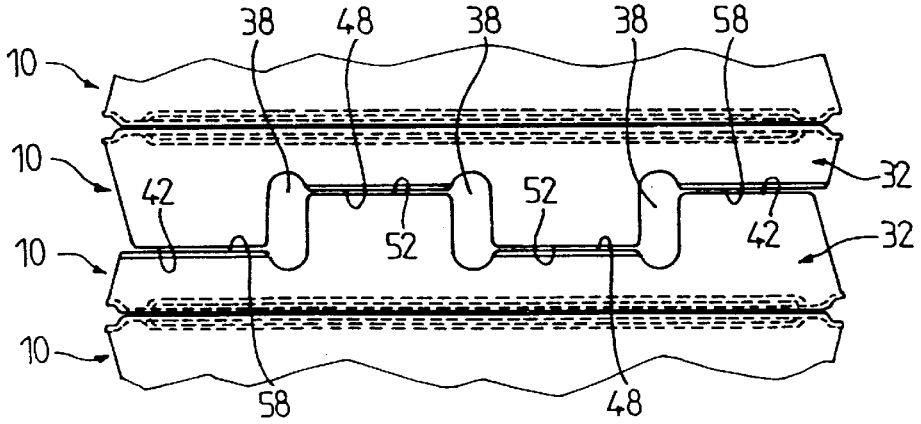
FIG. 4 is a top plan view showing part of a heat exchanger made from plates of the kind shown in FIG. 3.

When the pairs of plates of the heat exchanger are assembled together so that their plate feet 32 inter-penetrate as can be seen in FIG. 4, the longitudinal side 42 of the first projecting portion 34 abuts against the flange 58 of the adjacent plate 10. In addition, the flange 48 on the longitudinal side 46 in the first recess 36 abuts against the longitudinal side 52 of the second projecting portion 34 of the adjacent plate. The longitudinal side 52 of the other projecting portion 34 abuts against the flange 48 of the adjacent plate, while the flange 60 abuts against the longitudinal side 42 of the adjacent plate. The three flow passages 38 are defined by virtue of the fact that the projecting portions 34 are narrower than the recesses 36. As can be seen in FIG. 4, these flow passages 38 are substantially oval.

Thus, the two bent-back edge portions or plate feet 32 of two adjacent heat exchanger plates 10, forming part of two different pairs of plates, maintain the spacing between two pairs of plates while at the same time defining drain passages for the condensates produced by the stream of air passing through the evaporator.

The invention is of course not limited to the embodiment described above by way of example. For instance, it is possible to form the bent-back edge portions with indentations having other configurations, provided these indentations enable condensate drain passages to be provided.

In addition, although the invention has been described above with particular reference to an evaporator as the heat exchanger, it could be used for other types of heat exchanger of the stacked plate type, for example a condenser which is part of an air conditioning installation, in particular for a motor vehicle.

What is claimed is:

1. A heat exchanger for heat transfer between a first fluid and a second fluid, comprising a multiplicity of heat transfer plates stacked in pairs, each plate having a concave side and a communication aperture formed through the plate, the plates of each pair being secured together sealingly at their periphery with their concave sides facing towards each other, so as to define within the pair of plates a chamber for flow of the first fluid therein, the communication apertures of each plate in a pair of plates being juxtaposed to the corresponding apertures of a plate in an adjacent pair of plates, thereby putting the chambers into communication with each other through the apertures, respective said pairs of plates defining between them flow passages for said second fluid between one said pair and the next, and the heat exchanger further including corrugated inserts mounted in the flow passages for the second fluid, wherein each said plate has a bent-back edge portion lying at right angles to the remainder of the plate on the side of the latter opposite to its said concave side, all the plates being substantially identical to each other and each said bent-back edge portion being so configured as to abut against a corresponding bent-back edge portion of an adjacent plate, with the two cooperating bent-back edge portions defining at least one drain passage communicating with the corresponding said flow passage for the second fluid, wherein each bent-back edge portion is formed with indentations for interpenetrating with corresponding indentations of the bent-back edge portion of the adjacent plate, wherein each said indentation is defined by alternate projecting portions and recesses of equal numbers, such that the projecting portions of one bent-back edge portion engage in the recesses of the adjacent bent-back edge portion and vice versa, while leaving said drain passages clear, wherein, in each bent-back portion, each said recess is partly defined by a longitudinal side of the bent-back edge portion, each said projecting element having a transverse side partly further defining an adjacent said recess, the longitudinal side of each recess being joined at right angles to at least one said transverse side, each recess further defining a relieving notch at the junction of the longitudinal and transverse sides.

2. A heat exchanger according to claim 1, wherein each plate is of generally elongate configuration having a first end and a second end opposite to the first end, the plate having, close to said first end, at least one hollow projecting pocket in which a said communication aperture is formed, the bent-back edge portion of the plate being at the second end of the plate.

3. A heat exchanger according to claim 1, wherein the projecting portions and recesses are generally rectangular, the projecting portions being narrower than the recesses.

4. A heat exchanger according to claim 1, wherein the longitudinal side of each said recess includes an abutment flange.

5. A heat exchanger according to claim 1, further comprising a first fluid and a second fluid, wherein said first fluid is a refrigerant fluid and said second fluid is atmospheric air, whereby condensate in the atmospheric air, produced in the heat exchanger, can be removed through the drain passages.

6. A heat exchanger for heat transfer between a first fluid and a second fluid, comprising a multiplicity of heat transfer plates stacked in pairs, each plate having a concave side and a communication aperture formed through the plate, the plates of each pair being secured together sealingly at their periphery with their concave sides facing towards each other, so as to define within the pair of plates a chamber for flow of the first fluid therein, the communication apertures of each plate in a pair of plates being juxtaposed to the corresponding apertures of a plate in an adjacent pair of plates, thereby putting the chambers into communication with each other through the apertures, respective said pairs of plates defining between them flow passages for said second fluid between one said pair and the next, and the heat exchanger further including corrugated inserts mounted in the flow passages for the second fluid, wherein each said plate has a bent-back edge portion lying at right angles to the remainder of the plate on the side of the latter opposite to its said concave side, all the plates being substantially identical to each other and each said bent-back edge portion being so configured as to abut against a corresponding bent-back edge portion of an adjacent plate, with the two cooperating bent-back edge portions defining at least one drain passage communicating with the corresponding said flow passage for the second fluid, wherein each bent-back edge portion is formed with projecting portions for interpenetrating with corresponding recessed portions of the bent-back edge portion of the adjacent plate and each said pair of corresponding projecting and recessed portions of adjacent plate pairs positively abutting along offset lines and having a said drain passage defined on either side thereof.

7. A heat exchanger according to claim 6, wherein each plate is of generally elongate configuration having a first end and a second end opposite to the first end, the plate having, close to said first end, at least one hollow projecting pocket in which a said communication aperture is formed, the bent-back edge portion of the plate being at the second end of the plate.

8. A heat exchanger according to claim 6, wherein the projecting and recessed portions are generally rectangular, the projecting portions being narrower than the recessed portions.

9. A heat exchanger according to claim 8, wherein, in each bent-back portion, each said recessed portion is partly defined by a longitudinal side of the bent-back edge portion, each said projecting portion having a transverse side partly further defining an adjacent said recessed portion, the longitudinal side of each recessed portion being joined at right angles to at least one said transverse side, each recessed portion further defining a relieving notch at the junction of the longitudinal and transverse sides.

10. A heat exchanger according to claim 6, further comprising a first fluid and a second fluid, wherein said first fluid is a refrigerant fluid and said second fluid is atmospheric air, whereby condensate in the atmospheric air, produced in the heat exchanger, can be removed through the at least one drain passage.

* * * * *